United States Patent [19]

Heath

[11] Patent Number: 4,617,030

[45] Date of Patent: Oct. 14, 1986

[54] METHODS AND APPARATUS FOR SEPARATING GASES AND LIQUIDS FROM NATURAL GAS WELLHEAD EFFLUENT

[76] Inventor: Rodney T. Heath, 109 W. 31st, Farmington, N. Mex. 87401

[21] Appl. No.: 821,026

[22] Filed: Jan. 21, 1986

Related U.S. Application Data

[63] Continuation-in-part of Ser. No. 732,379, May 8, 1985, Pat. No. 4,579,565, which is a continuation-in-part of Ser. No. 537,298, Sep. 29, 1983, abandoned.

[51] Int. Cl.[4] ..... B01D 19/00; B01D 53/14

[52] U.S. Cl. ..... 55/20; 55/23; 55/24; 55/44; 55/163; 55/174

[58] Field of Search ..... 55/20, 23, 24, 32, 38, 55/40, 42, 44, 45, 55, 163, 189, 171–177, 195

[56] References Cited

U.S. PATENT DOCUMENTS

| | | | |
|---|---|---|---|
| 2,690,814 | 10/1954 | Reid | 55/32 |
| 2,728,406 | 12/1955 | Maher | 55/42 |
| 2,765,045 | 10/1956 | Meyers | 55/174 X |
| 3,119,674 | 1/1964 | Glasgow et al. | 55/174 X |
| 3,331,188 | 7/1967 | Sixex | 55/174 X |

*Primary Examiner*—Charles Hart
*Attorney, Agent, or Firm*—Klaas & Law

[57] ABSTRACT

A system for processing natural gas wellhead effluent comprising a three phase low pressure separator connected to the wellhead, a compressor connected to the low pressure separator and a two phase high pressure separator connected to the compressor and the sales gas pipe line. The compressor receives relatively low pressure gases from the low pressure separator and compresses the gases to a relatively high pressure and temperature. The high pressure and temperature gases pass from the compressor to the high pressure separator through a heat exchanger in the low pressure separator to provide heat for operation of the low pressure separator and then through a cooler to reduce the temperature of the gases prior to entry into the high pressure separator at a pressure and temperature approximately equal to gas pipe line pressure and temperature. Residual liquid hydrocarbons in the compressed gases are removed in the high pressure separator and returned to the low pressure separator and sales gas is delivered to the sales gas pipe line from the high pressure separator.

24 Claims, 9 Drawing Figures

METHODS AND APPARATUS FOR SEPARATING GASES AND LIQUIDS FROM NATURAL GAS WELLHEAD EFFLUENT

This is a continuation-in-part of my copending U.S. patent application Ser. No. 732,379 filed May 8, 1985, and now U.S. Pat. No. 4,579,565 which is a continuation-in-part of Ser. No. 537,298 filed Sept. 29, 1983, and now abandoned for Methods and Apparatus For Separating Gases And Liquids From Natural Gas Well-Head Effluent, the benefit of the filing dates of which are claimed herein and the disclosures of which are incorported herein by reference.

FIELD OF THE INVENTION

This invention relates generally to the separation of gases and vapors from the liquids present in the wellhead gas effluent from natural gas wells. In particular, this invention relates to a method and apparatus for improving the production of sales gas from relatively low volume natural gas wells by the use of compression.

BACKGROUND

As described in my prior applications, many natural gas wells produce a relatively high pressure, high volume well stream effluent containing significant volumes of high vapor pressure condensates which will normally contain absorbed and dissolved natural gas, propane, butane, pentane and the like. Currently these liquid and dissolved hydrocarbons are only partially recovered by conventional, high pressure, separator units. The liquid hydrocarbon by products normally removed from the well stream by a high pressure separator unit, are collected and then typically dumped to a low pressure storage tank means for subsequent sale and use. A substantial amount of dissolved gas and high vapor pressure hydrocarbons remain in the liquid hydrocarbon by-products. Substantial amounts of these gases and hydrocarbons may vaporize by flashing in the storage tank due to the substantial reduction in pressure in the tank which permits the volatile components to evaporate or off-gas into gas and vapor collected in the storage tank over the condensate. In this manner, substantial amounts of gas and entrained liquid hydrocarbons are often vented to the atmosphere to reduce storage tank pressure and are wasted. In addition to this initial vaporization and loss, further evaporation occurs when the condensate stands for a period of time in the storage tank or when the condensate is subsequently transported to another location or during subsequent storage and/or processing. This is described in the industry as weathering. Many users of the condensate specify particular low vaporization pressure requirements for such condensate; and the salability and value of the condensate depends upon the characteristics of the condensate. Thus, natural gas wells, which produce significant amounts of high vapor pressure condensates along with the natural gas, present a great opportunity for improvement in production methods including a reduction in discharge to the environment and economic gain by recovery of otherwise wasted by-products.

While the apparatus and methods disclosed in my prior applications enable enhanced recovery of sales gas and hydrocarbon condensates in relatively high pressure, high volume wells, there is a need for improved production apparatus and methods for use with relatively low volume gas wells, (e.g., 1.5 million cubic feet per day or less). One of the problems with relatively low volume gas wells is that the pressure differential between shut-in and/or natural flow pressure of a small volume gas well and the pressure of the sales gas from other wells in the sales gas pipe line may be so low as to reduce and/or restrict the volume of production from the low volume wells because of inability to establish and maintain flow from the wellhead to the sales gas pipe line through the production equipment. Another problem with relatively low volume natural gas wells is that the natural flow pressure may vary substantially depending upon changes in formation conditions and the amount of liquid hydrocarbons and water in the well. Removal of liquid hydrocarbons and water is dependent upon the rate of flow of natural gas which may be so low in low volume wells as to prevent removal of sufficient quantities of the liquid hydrocarbons and water resulting in further reduction in rate of flow and sometimes, a well shut down condition which requires special procedures to unload the well to reestablish natural flow. Thus, it is desirable to establish and maintain sufficient pressure differentials between the sales gas pipe line pressure, the production equipment, and the natural flow pressure of the low volume well to assure satisfactory flow from the well into the production equipment and from the production equipment to the sales gas pipe line. For example, if the sales gas pipe line pressure is 500 psi and the shut-in or natural flow pressure of a low volume well is only 700 psi or lower, the pressure differential between the well head and the sales gas pipe line is only 200 psi or lower and may have an adverse effect on the flow rate from the well head. When the pressure differential is increased, for example, from 200 psi to 500 psi or more, the resistance to flow from the well head is reduced, and the volume and rate of gas flowing from the low volume well to the sales gas pipe line ma be substantially increased.

The construction of apparatus and utilization of methods of processing natural gas wellhead effluent at the well site requires consideration of a multitude of factors which are unique to variable conditions at the wellhead site. First, many wellhead sites are located in remote areas where there are no on-site operating personnel and which are not readily accessible by remotely located operating personnel. Second, many wellhead sites are located in geographical areas subject to extreme changes in climatic conditions from a winter period with ice, snow and extremely low temperature conditions (e.g., 32 degrees F. to −50 degrees F.) to a summer period with extremely high temperature conditions (e.g., 90 degrees F. to 120 degrees F.). Thus, while environmental conditions may be controlled at central processing and production plants, environmental conditions at a natural gas wellhead site are generally uncontrollable and processing and production equipment at the wellhead site are subject to extreme environmental conditions without constant availability of on-site maintenance and operating service personnel. Thus, an important consideration feature and object of the present invention is to provide reliable, substantially maintenance free and service free production apparatus and methods which are usable at a wellhead site. Some types of oil-gas production apparatus and methods which may be satisfactorily operated in a controlled environment at a central production facility cannot be reliably operated at a wellhead site. Thus, the design of on-site wellhead production equipment and processes requires consideration of many factors which are not applicable to central production facilities.

The terms, gaseous hydrocarbon hydrate temperature and the like, as used herein, are known terms of art which mean a relatively low temperature at which gaseous hydrocarbons form a porous solid. This solid is crystallized in a cubic structure in which gas molecules are "trapped" in cavities. Hydrates are capable of blocking flow of gaseous hydrocarbons in a processing system. The formation of such hydrates is a function of the kind of hydrocarbon, associated free water and pressure and temperature conditions thereof. Exemplary known hydrate temperatures are shown in various prior art publications. The systems of the present invention are designed to operate at temperatures above gaseous hydrocarbon hydrate temperatures.

In general, the low pressure and high pressure separator means of the present invention comprise a vessel (tank) of any size or shape mounted in either a vertical or horizontal attitude and designed and constructed and arranged to operate at suitable pressures and at elevated temperatures in excess of process gas hydrate temperatures. Fluids in such vessels are primarily mechanically separated into gaseous and liquid phases by change of direction of flow, decrease in velocity, scrubbing, etc. in a two-phase (gaseous/liquid separation) or three-phase (gaseous/liquid separation and then water-hydrocarbon liquid separation). Suitable level controls, motor valves, temperature controllers, etc. are utilized to maintain the desired continuous process conditions.

BRIEF INVENTION SUMMARY

The apparatus and methods of my prior applications provide for enhancing the overall production of natural gas wells by the use of multiple stages of gas-liquid separation in a process wherein the pressure on the condensate is reduced in a manner that increases the recovery of absorbed gases and vapors before the transfer of the remaining liquid to a storage tank at nearly atmospheric pressure, and includes compressing the gases and vapors recovered from separation stages, and then reintroducing these recovered components back into the wellhead stream, under specific predetermined conditions, which also enhances the recovery of both lighter and heavier hydrocarbon components which might otherwise be wasted. Compressor means are employed to receive and compress by-product gas from separator means provided in the system, and for subsequently injecting compressed gases and vapors into the wellhead gas stream at a predetermined location for recycling under conditions which facilitate enrichment of the volume, composition and B.T.U. content of the sales gas stream as well as liquid hydrocarbon recovery. In one embodiment, an intermediate staging separator may be employed which, in a preferred embodiment, may, in addition contain heat exchanger means whereby some of the heat of compression imparted to the compressed gases and vapors by the compressor means is used to maintain a predetermined temperature in the staging separator.

In general, the presently disclosed system enables processing of effluent from a low volume natural gas wellhead as discharged at the wellhead site at wellhead discharge pressures and temperatures, the effluent constituents comprising light end and heavy end hydrocarbons and water in gaseous, liquid and vapor phases, to remove water and heavy end hydrocarbons from the effluent and to provide an increased volume of sales gas containing primarily light end hydrocarbons in a stable gaseous phase and to provide heavy end hydrocarbons in a relatively stable liquid phase without substantial loss of either of the light end hydrocarbons or the heavy end hydrocarbons during processing of the effluent. In one embodiment, the apparatus comprises a three phase low pressure primary separator means for continuously receiving the wellhead effluent and for continuously separating the effluent into (1) a first relatively low pressure body of gaseous light end hydrocarbon constituents and (2) into a liquid body of water constituents and (3) into a first liquid body of residual hydrocarbon constituents including a minoral residual portion of the light end hydrocarbon components and a majoral residual portion of heavy end hydrocarbon components in liquid and vapor phases. A compressor means is located downstream of the primary separator means for reducing the working pressure in the primary separator means while continuously inducing a flow of gaseous hydrocarbon constituents from the primary separator means and increasing the pressure thereof by compression in the compressor means. A two phase high pressure secondary separator means is located downstream of the compressor means for continuously receiving the relatively high pressure gaseous and residual hydrocarbon constituents from the compressor means at a relatively high pressure and for causing separation of the residual hydrocarbon constituents to provide a second body of relatively high pressure residual gaseous light end hydrocarbon components of sales gas quality and a second liquid body of residual heavy end hydrocarbon components. The second body of residual gaseous hydrocarbon constituents contains primarily light end hydrocarbon constituents with a minority of heavy end hydrocarbon constituents therein and is discharged to the sales gas line at a relatively high pressure approximately equal to the sales gas line pressure.

The inlet suction port of the compressor means is connected to the low pressure primary separator means to establish and maintain a substantial constant flow rate of effluent to and separated gas from the low pressure primary separator means. The discharge port of the compressor means is connected to the high pressure secondary separator means through heating coil means in the low pressure primary separator means so that the heat of compression in the compressed gas is used to heat the low pressure primary separator means. Cooling means are employed to cool the compressed gas prior to entry into the high pressure secondary means wherein additional residual heavy end hydrocarbons are removed from the gas prior to delivery to the sales gas line. A condensate sump means in the high pressure secondary separator means is mounted in the low pressure primary separator means in heat transfer relationship with the condensate liquids collected in the low pressure primary separator means. The condensate liquids from the high pressure secondary separator means collected in the sump means are dumped into and mixed with the condensate liquids in the low pressure primary separator means for recycling therein. A natural gas powered engine means drives the compressor means and the engine coolant system may include circulation lines located in the low pressure primary separator means in heat transfer relationship with the condensate liquids therein. The compressed gas cooling means may be a forced air-engine radiator apparatus associated with the engine means. Fuel gas for the engine means and control gas for system control devices are derived from the sales quality gas produced in the high pressure secondary separator means. A suction scrubber means may be used between the low pressure primary separator means and the compressor means to remove additional heavy end hydrocarbons and water in the gas prior to delivery to the compressor means. The system apparatus is mounted on a portable platform means.

BRIEF DESCRIPTION OF THE DRAWINGS

Presently preferred and illustrative embodiments of the invention are shown in the accompanying drawings wherein:

FIG. 6 is a plan view of apparatus illustrated in FIGS. 5 and 5*a.

DETAILED DESCRIPTION OF FIGS. 1–4

Figure 1:
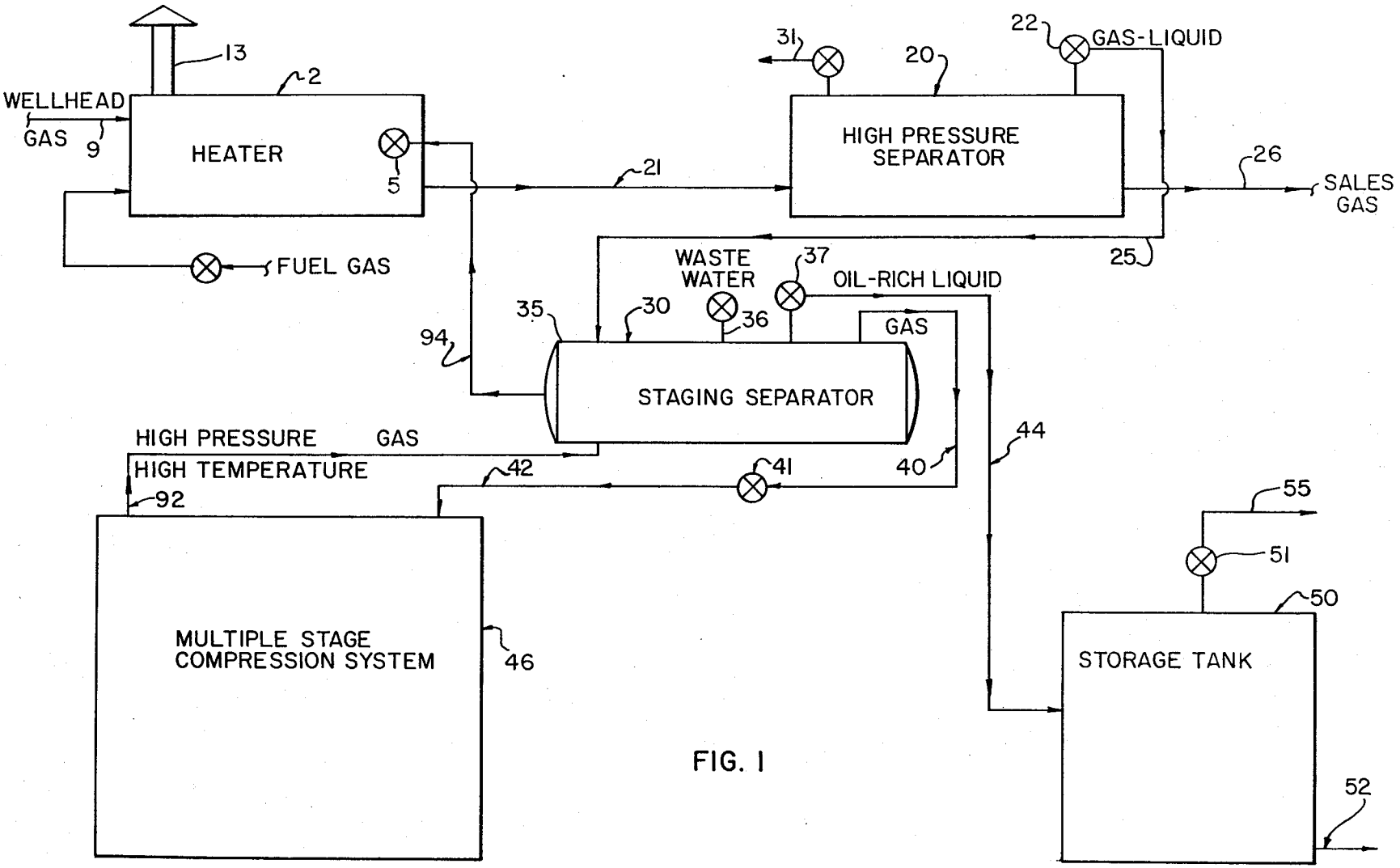
FIG. 1 is a schematic flow diagram of a system of the prior applications for separating gases from the condensible liquids present in natural gas wellhead effluent.
Figure 2:
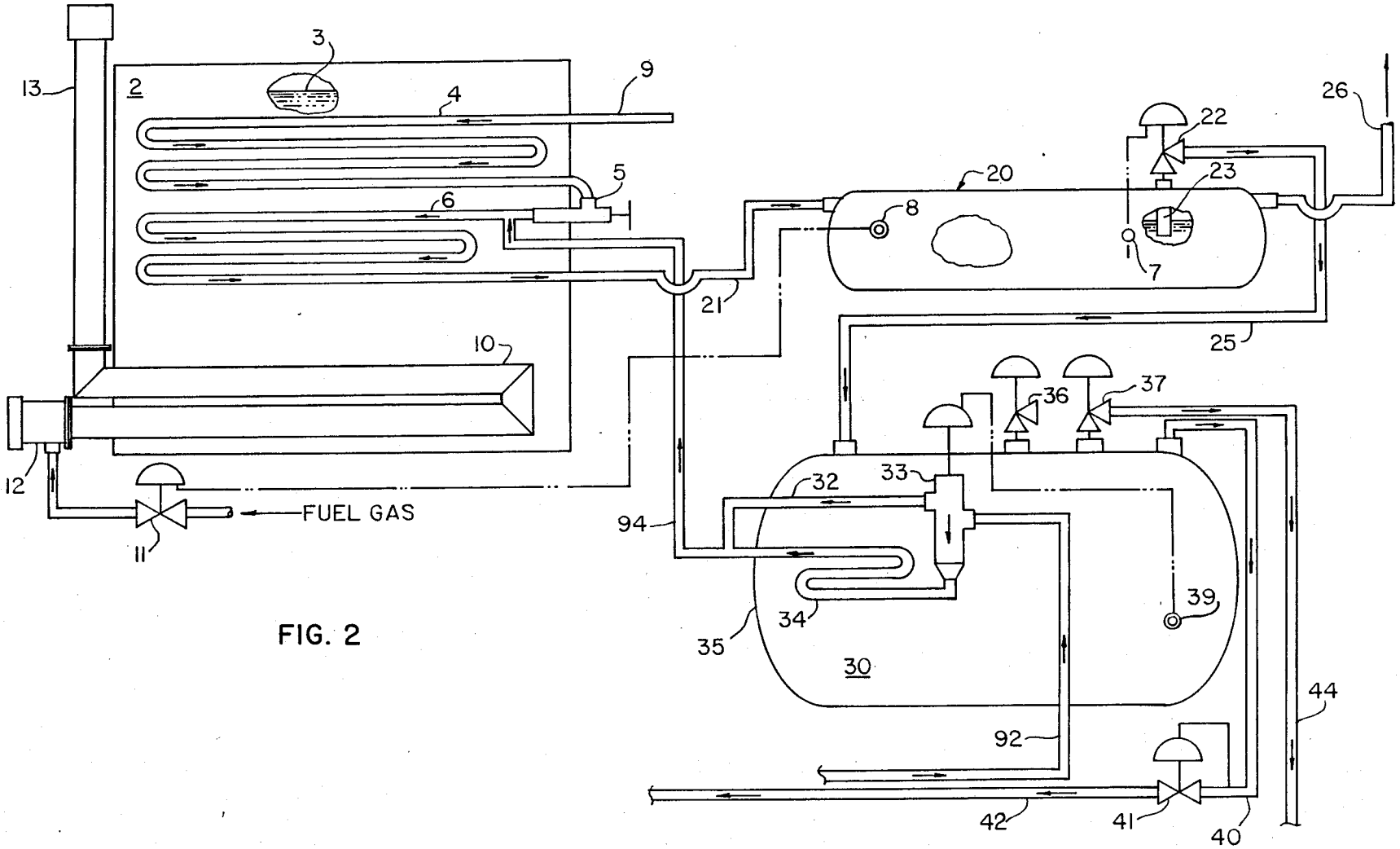
FIG. 2 is a partial flow diagram of the heater, high pressure separator, and staging separator apparatus used in a system of the prior applications.

A gas-liquid separation apparatus and method of the prior applications is shown schematically in FIGS. 1 and 2, with a conventional heater means 2 having a heat exchanging tube coil means 4 into which the gaseous product from a wellhead are introduced from an inlet conduit 9. The wellhead gases are conveyed via interconnected gas heating coil means 4 and 6, which are immersed in an indirect heating medium 3, such as a glycol and water solution in heater 2. A pressure reducing choke valve means 5 is inserted in the pipe connecting gas heating coils 4 and 6, and is used to reduce the wellhead pressure to a pressure compatible with the operating pressure of a conventional three phase high pressure primary separator means 20 and the sales gas line 26. The heating medium 3 can be heated by means of a conventional fire tube heater shown at 10. The temperature of fire tube heater 10 is controlled by means of a thermostatically controlled gas supply valve 11 connected to a gas burner unit 12, and the heater 10 is connected to a flu 13.

Figure 4:
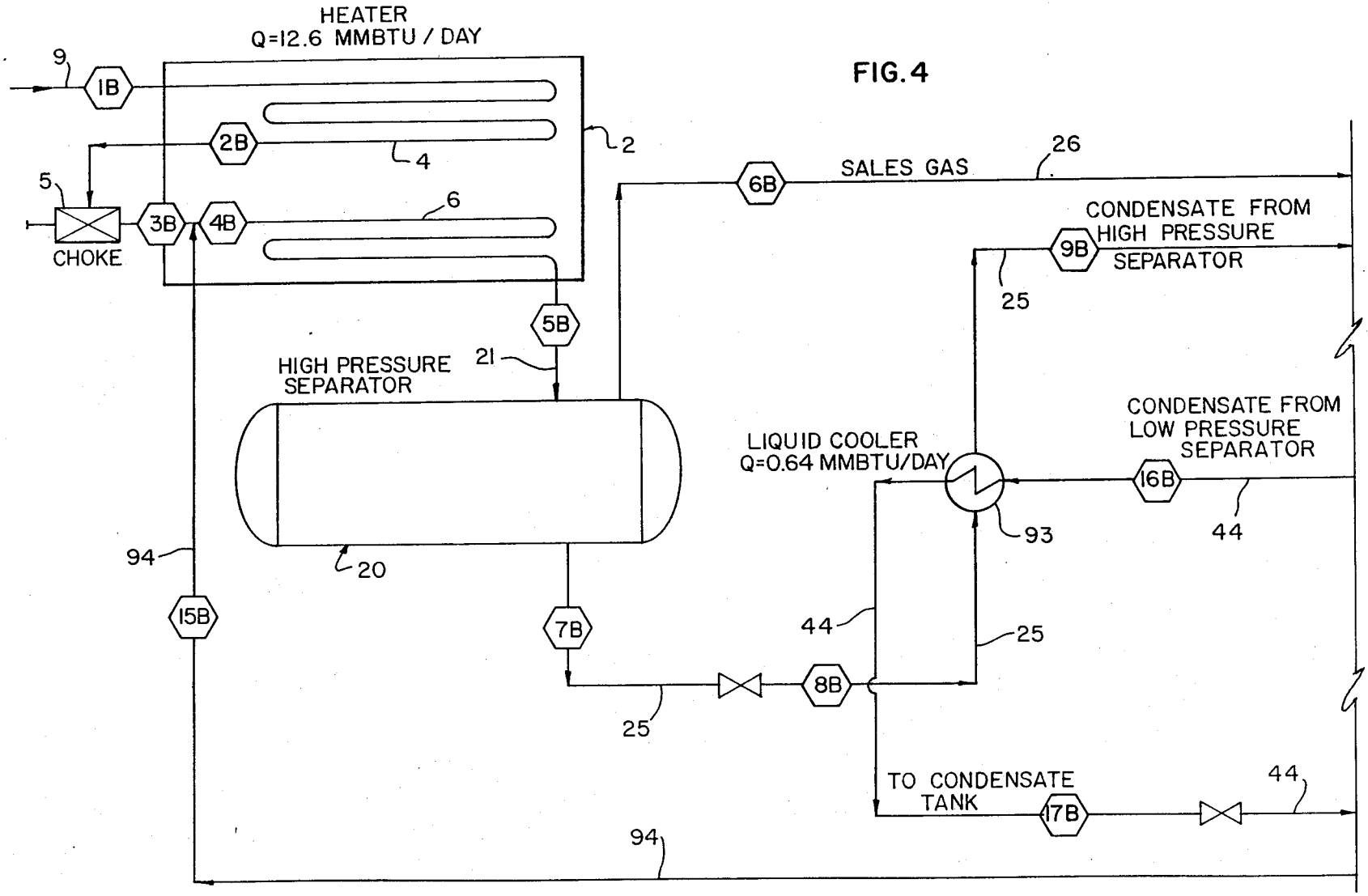
FIGS. 4 and 4*a* are a schematic drawing of one embodiment of a system employing methods and apparatus of the prior applications.

Heating coil 6 is connected to high pressure separator 20 by means of a pipe 21. This high pressure separator 20 operates to mechanically separate gaseous and liquid components of the well stream at a predetermined elevated operating temperature and pressure as is well known in the art. Typically the gas-liquid mixture introduced into high pressure separator 20 will be at a pressure of from about 1,000 psig to about 400 psig and temperature of from about 70 degrees F. (22 degrees C.) to about 90 degrees F. (33 degrees C.). The valve 22 is controlled by the liquid level inside the high pressure separator 20 such that when the liquid level of the liquid hydrocarbons reaches a predetermined height, the valve 22 will be opened drawing off the liquid under the pressure of the gaseous component by means of pipe 25 which transmits the liquid component to another conventional separator means such as an intermediate pressure staging separator 30. The gaseous sales gas components are removed from the high pressure separator by means of pipe 26, and are subsequently sold after further processing, if necessary. The sales gas may advantageously be further dried by the removal of water using for example, a conventional glycol dehydration system. Liquid water collected in separator 20 is removed through a pipe 31 in a conventional manner. The intermediate pressure or staging separator 30 is generally operated at pressures of less than about 125 psig. Most of the absorbed natural gas and some of the higher vapor pressure components of the condensates removed from the high pressure separator 20 will be flashed from the liquid phase into the vapor phase in the intermediate pressure separator 30. As shown in FIG. 2, the intermediate pressure separator 30 consists of a tank 35, a water dump line valve 36, an oil (condensate) line dump valve 37, an oil liquid level control and water liquid level control (not shown), a thermostat 39, a heat exchange coil 34, a bypass line 32, and a three way temperature splitter valve 33, as well as safety and control monitoring devices such as gauge glasses, safety release valves and the like. The oil dump valve 37, which operates in response to the oil liquid level control (not shown), passes oil from the intermediate pressure separator 30 via pipe 44 into a conventional storage tank means 50, (shown in FIG. 1). The primary function of the intermediate pressure separator 30 is to flash at a higher than atmospheric pressure most of the absorbed natural gas and high vapor pressure components of the condensates into a vapor phase. The flashed gases are removed from intermediate pressure separator 30 by means of a pipe 40 through a back pressure valve 41 and conveyed through a conduit 42 into a multiple stage compression system 46, shown in detail in FIGS. 4 and 4*a*.

Residual hydrocarbons in the gas stream produced in the secondary separation means 30 and compressed in the compression system 46 are recycled by delivery from the compression system to the heated wellhead effluent stream by conduit means 92, 94 which may include heat exchanger and valve means 32, 33, 34 in secondary separator means 30. In this manner, all residual light end hydrocarbons not released to the sales gas stream in primary separator 20 are further processed in secondary separator means 30 which provides a liquid body of hydrocarbons substantially free of light end hydrocarbons for delivery to the storage tan means 50 while producing a secondary gaseous stream of hydrocarbons which is recyclable after passing through the compression system 46 as hereinafter described.

Figure 3:
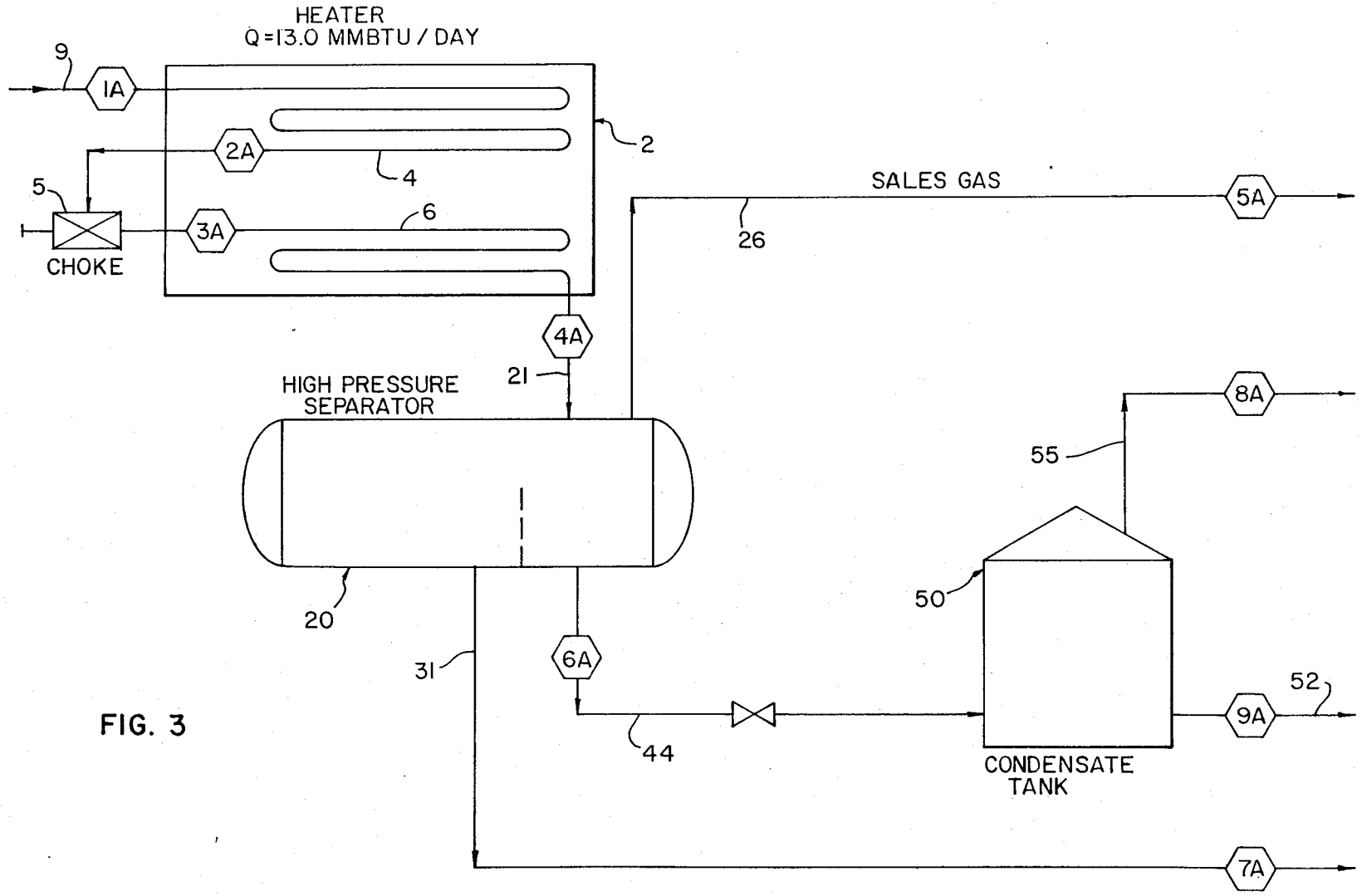
FIG. 3 is a schematic drawing of a typical, single, high pressure gas-liquid separator process which does not employ the present invention.

The liquid condensate storage tank 50 operates at nearly atmospheric pressure. The further pressure reduction from the pressure in the intermediate pressure separator 30 will permit some further flashing of the hydrocarbons to occur as the pressure is reduced. A pressure relief valve 51 as shown in FIG. 1, is provided for pressure control on the storage tank 50. Condensate is selectively removed from storage tank 50 through discharge pipe 52. The flashed gases and vapors are removed from storage tank 50 by means of a vent pipe 55. FIG. 3 shows a typical conventional system wherein heavy end condensate (oil) is directly delivered from high pressure separator means 20 to storage tank means 50 in a relatively unstable condition with resulting loss of substantial amounts of light end hydrocarbons.

Figure 4A:
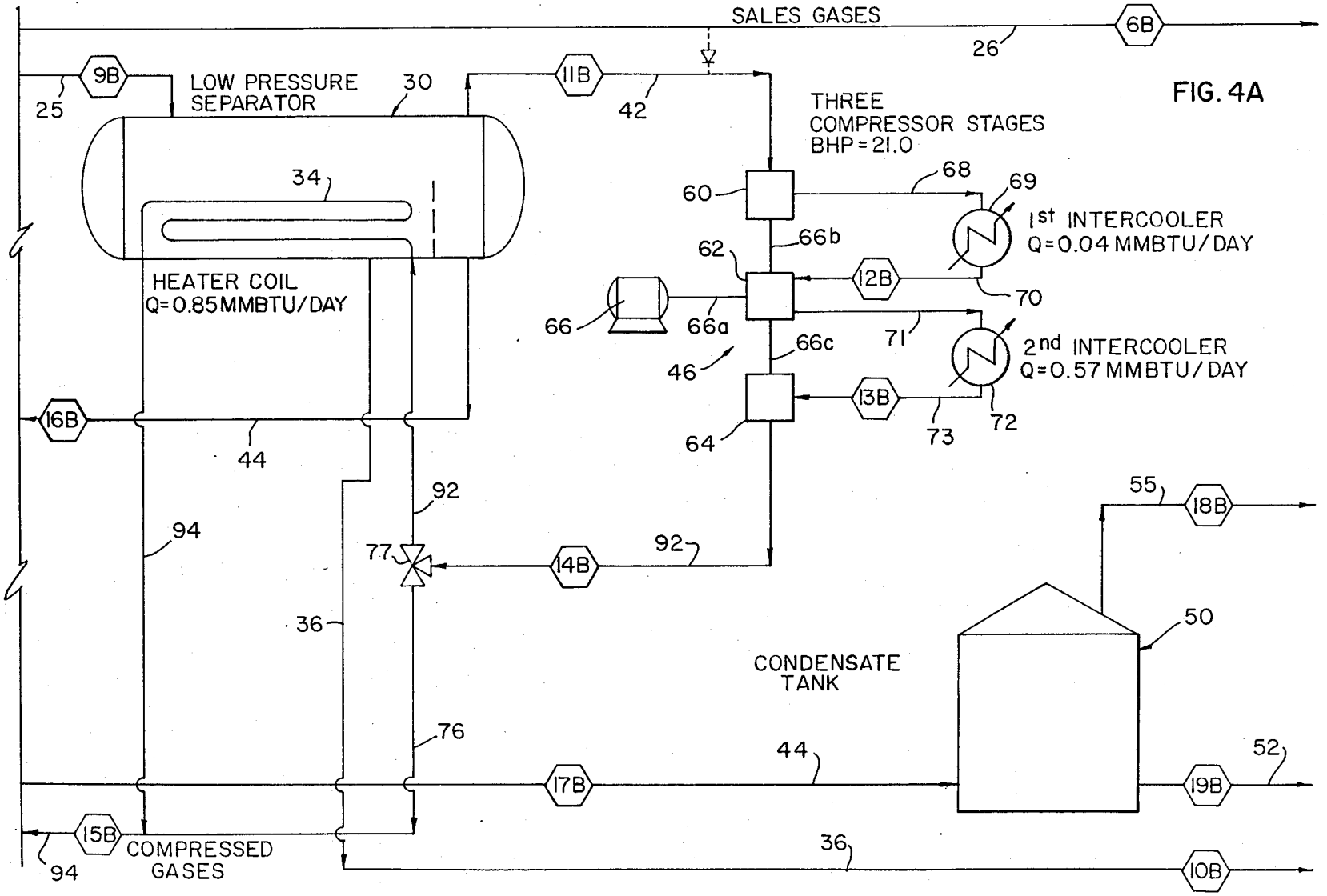

As shown in FIG. 4*a*, multiple stage compression system 46 comprises a series of conventional compressor cylinder-piston units 60, 62, 64 driven by conventional motor means 66 through suitable drive means 66*a*, 66*b*, 66*c*. Gaseous hydrocarbons in low pressure separator 30 are delivered to first stage compressor unit 60 through line 42 and compressed therein to raise the temperature and pressure thereof. The compressed gaseous hydrocarbons are then delivered to the second stage compressor unit 62 through a line 68, a conventional forced draft intercooler unit 69, including an inner-stage separator and a line 70. The gaseous hydrocarbons are again compressed in compressor unit 62 and then delivered to third stage compressor unit 64 through a line 71, a second forced draft intercooler unit 72, including an inner-stage separator and a line 73. The intercooler units 69, 72 cause reduction of temperature of the relatively high pressure high temperature gaseous hydrocarbons resulting in the recondensing and then removal of additional liquid heavy end hydrocarbons which are delivered to the low pressure separator 30 or condensate tank 50 through suitable line means (not shown). The remaining relatively high pressure high temperature gaseous hydrocarbons are delivered indirectly from the final compressor unit 64 to heater unit 2 (FIG. 4) between choke valve 5 and heating coil 6 through discharge lines 92, heat exchanger means 34, line 94, and/or directly through bypass line 76 as determined by temperature controlled splitter valve means 77. Water collected in separator 30 is removed in a conventional manner through discharge line 31. The multiple stages of compression provided by compression system 46 may be used to compress the gas up to the pressure of the gas line immediately downstream of the choke valve 5 in the heater 2. Preferably the compressed gases are transferred, as by line 92, shown in FIG. 2, to heat exchanger 34 in the staging separator 30 to recover some of the heat of compression to heat the fluids in the staging separator for greater gas and vapor recovery from the separated liquids in the staging separator before the liquids are discharged to the storage tank 50. Most preferably the compressed gases from the transfer pipe 92 are introduced into the three way temperature control splitter valve 33 or 77 which is external of the staging separator 30. The three way splitter valve 33 controls the introduction of the high pressure and high temperature compressed gases from the compressor means by means of a thermostat 39 which senses the temperature of the liquids contained in the separator 30. The three way splitter valve 33, receiving the gases and vapors from the last stage of the compressor means diverts the high pressure, high temperature gases either directly to heat exchanger 34, inside the staging separator 30, when required, or bypasses the heat exchanger 34, depending on the conditions required in the intermediate pressure separator 30, and then through transfer line 94 for reintroduction of the gas and vapor into the gas heating coil 6 contained in heater 2 at a point downstream of choke valve 5. The heat from the heated liquids in the staging separator may be used to raise the temperature of the liquids going to the staging separator from the high pressure separator and to cool the liquids going to the storage tank 50 by providing a heat exchanger 93, FIG. 4, between these two lines.

DETAILED DESCRIPTION OF FIGS. 5-7

FIGS. 5, 5*a* and 6 and 7, show a production system for a low volume well comprising a three phase low pressure primary separator means 100 of generally conventional construction, a compressor means 102 operable by a conventional gas driven engine means 103, and a two phase high pressure secondary separator means 104 of generally conventional construction. Wellhead effluent is delivered to low pressure separator means 100 from a wellhead inlet line 106 through a high pressure shut-off control valve 107 for first stage separation of gaseous and liquid hydrocarbon and water components and production of a first stage gaseous stream delivered to the suction ports 108*a*, 108*b* of compressor means 102 from a dome means 109 having a mist extractor means 109*a* through a line 109*c*, a scrubber means 110 having a mist extractor means 110*a* and lines 111, 112. Compressor means 102 compresses the first stage gaseous stream and discharges a compressed gaseous stream from outlet ports 113, 114 to a line 115 for delivery to a heating coil means 116 in separator means 100 through an inlet port 118. A conventional splitter valve means 120 is connected to line 115 through a by-pass line 121, to heating coil means 116 through an outlet line 122 and to a discharge line 123 to enable separator temperature controlled variable flow of compressed gases from inlet line 115 to outlet line 123 through heating coil means 116 and/or to outlet line 123 through heating coil bypass line 121. Compressed gases in line 123 are delivered to a forced draft cooler means 126, including a radiator-type heat exchanger means 127 and an engine driven fan means 128, for cooling the compressed gases prior to delivery to the high pressure two phase secondary separator means 104 through a line 130. Separator means 104 provides a second stage, two phase separation process for the compressed gases to produce a body of residual liquid hydrocarbon components and sales quality body of gases delivered to the sales gas line through an outlet line 131 and a check valve means 132.

Separator means 104 comprises a liquid hydrocarbon collection tank means 140 with a lowermost portion 141 extending into separating means 100 for partial immersion in the liquids contained therein. A conventional liquid level control means 142 and a conventional dump valve means 144 are associated with tank means 140 for returning second stage liquid hydrocarbons to the first stage separator means 100 for recycling therein through a line 146. A conventional supply gas dryer means 148, for removing water and hydrocarbons in vapor phase by ambient cooling, provides system fuel and control supply gas to a line 150 connected through a heat exchange means 152, mounted in separator means 100, a line 154, a conventional pressure regulator means 156, and a line 158 to a conventional drip pot means 60, for removal of liquids, having a conventional high level shut down control valve means 161.

Fuel supply gas is delivered from drip pot means 160 to engine means 103 through a line 162 and a conventional fuel gas volume pot means 163, for holding a relatively large volume of pressure regulated gas, having variable pressure chambers 163*a*, 163*b* and associated pressure control valve means 164, 165. Engine starter gas is delivered to a conventional starter engine (not shown) from a high pressure side 163*a* of pot means 163 through line 166 including a starter valve means 167 and a starter oil lubricating means 168. Engine running gas is delivered from a low pressure side 163*b* of fuel pot means 163 through a line 169 including a fuel shutdown safety valve means 170.

Control supply gas is delivered from drip pot means 160 through a conventional pressure regulator means 171 and lines 172 to various conventional gas-operated control devices including pressure control valve 107 and associated controller 174, splitter valve 120 and associated thermostatic control 175, liquid level control valve 142 and dump valve 144, low pressure separator liquid level control valves 177, 178 and associated dump valves 179, 180, and scrubber means liquid level control valve 181 and associated dump valve 182.

Coolant for engine means 103 may be circulated through a line 184, heat exchanger means 185 in pot means 163, a line 186, a heat exchanger means 187 in the low pressure separator 100, a line 188, a heat exchanger means 189 in scrubber means 110, and a line 190. In this manner, the engine coolant may be used to provide heat to the separator means 100 and other apparatus as necessary or desirable. In addition, the engine coolant system includes inlet and outlet lines 192, 193, 194, 195 to radiator means 196 of forced draft cooler means 126 for cooling during normal operation, and further includes conventional coolant expansion tank means 198 and oil storage tank means 199.

Liquid hydrocarbons collected in first stage separator means 100 are delivered in a conventional manner to a conventional condensate storage tank means 200, through a line 201 connected to level control valve means 180. Scrubber means 110 is also connected to the condensate storage tank means 200 by a line 202. Water collected in first stage separator means 100 is removed in a conventional manner through a drainage line 204 connected to level control valve means 179. Any gases which are vented under abnormally high pressure operating conditions are removed through a pressure relief control valve means 206 and delivered through a line 207 to vent gas flare means 208 in a conventional manner. Various conventional pressure and temperature gauges 209, 210, 211, 212 and pressure and temperature responsive safety vent and shutdown valve devices 213, 214, 215, 216, 217, 218, 219, 220, etc., are employed in the system. Bypass lines such as coolant bypass line 222 with hand valve 223 between line 188 and line 184 and gas bypass line 224 with a hand valve 225 between line 109*c* and line 115, are provided as necessary and desirable.

In the illustrative embodiment, the low pressure separator means comprises an elongated cylindrical tank, having a 30 inch outside diameter and a length of approximately six and ½ feet which is constructed and arranged for operation at a normal relatively low working pressure of, for example, approximately 250 psig. The high pressure separator means comprises an elongated cylindrical tank, having an outside diameter of approximately 13 inches and a length of approximately four and ⅓ feet, which is constructed and arranged for operation at normal relatively high working pressure of, for example, up to approximately 1000 psig. The suction scrubber means 110 comprises an elongated cylindrical tank, having an outside diameter of approximately 14 inches and a length of approximately five feet, which is constructed and arranged to have a normal working pressure of, for example, approximately 250 psig. The engine means 103 may be a Caterpillar Model 3306 TALCR gas engine. The compressor means 102 may be an Ariel Model JGP-2-1 w/2 with five and ⅛ inch DA cylinders.

Figure 5A:
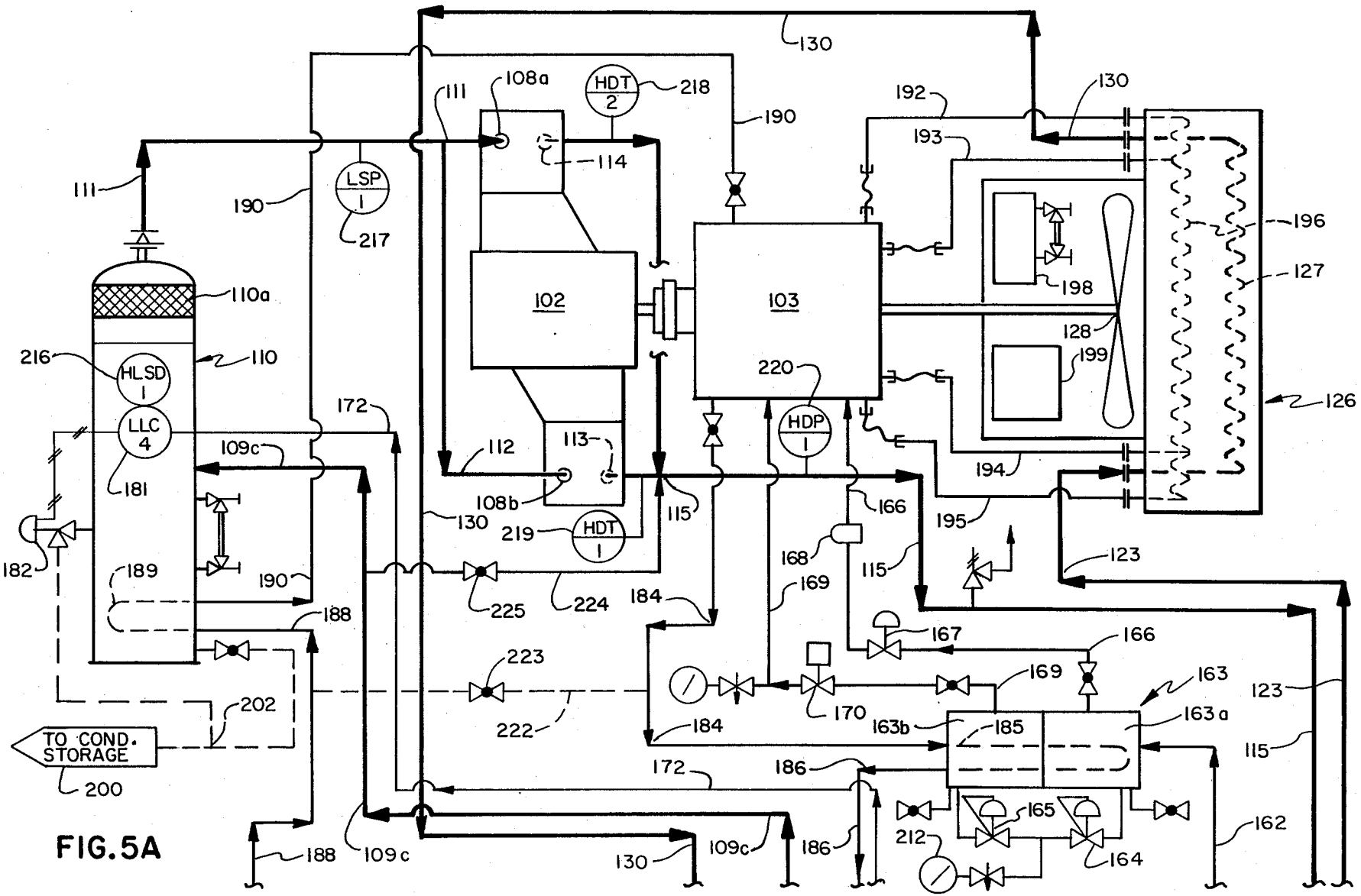
FIGS. 5 and 5*a* are a schematic drawing of an illustrative embodiment of the present invention as applied to a low volume well head.
Figure 5B:
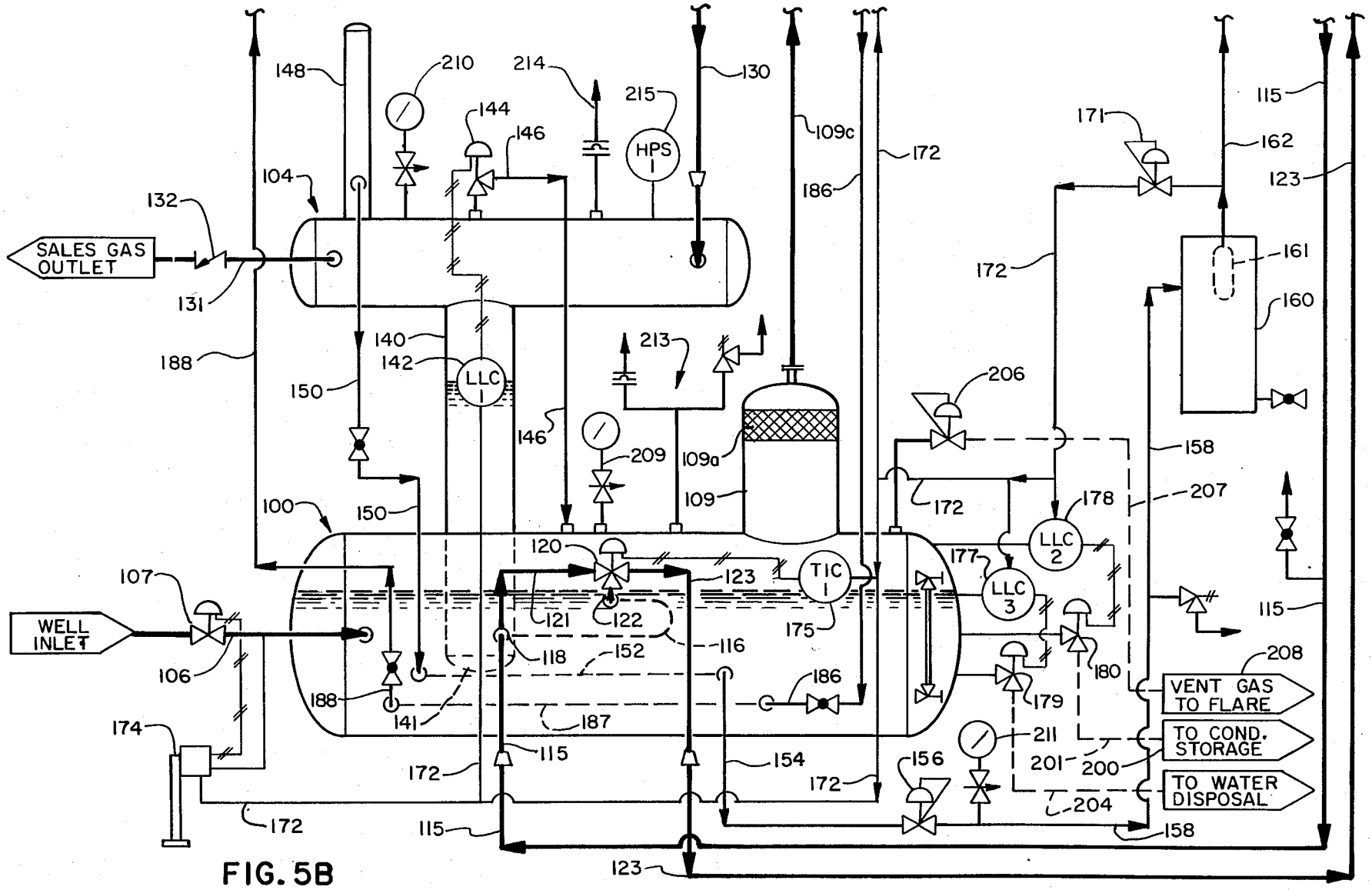
Figure 6:
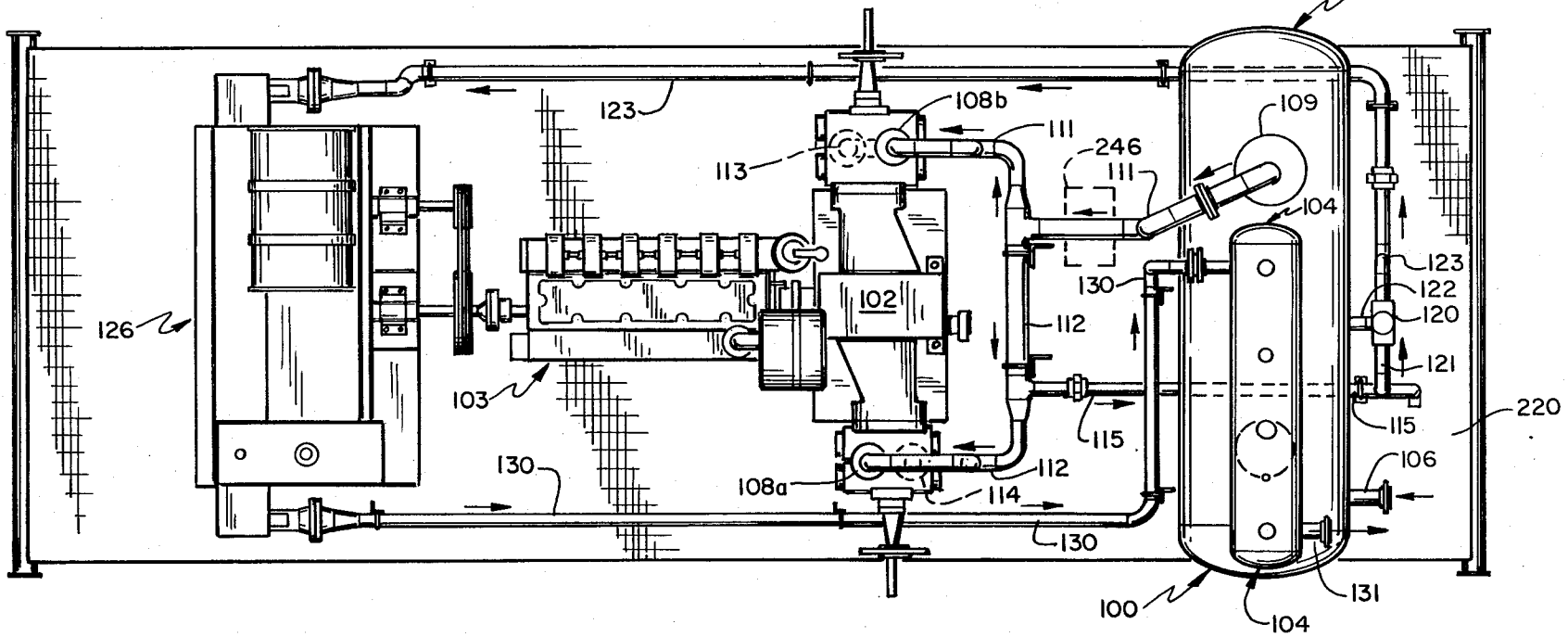
Figure 7:
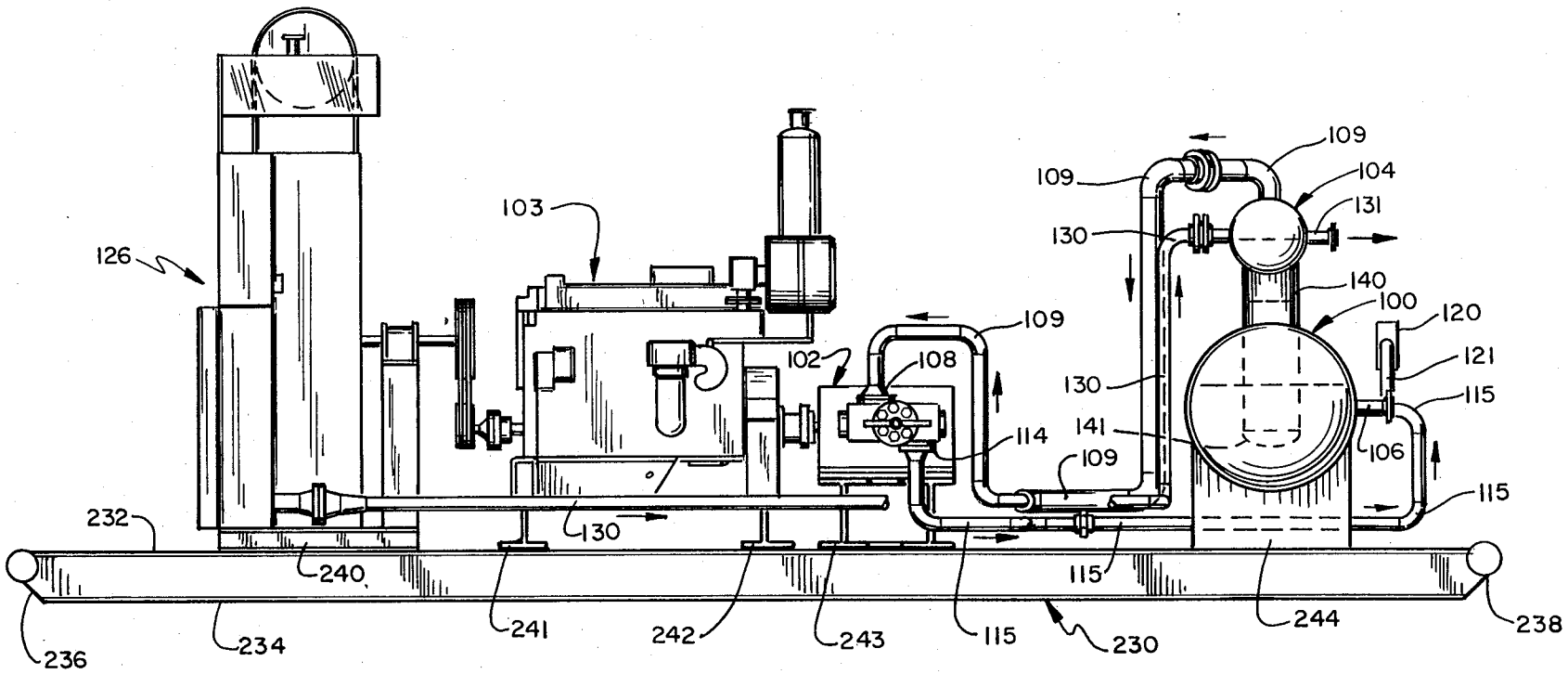
* and FIG. 7 is a side elevational view of the apparatus of FIG. 6.

FIGS. 6 & 7 show an illustrative construction and arrangement of the main components of a system of the type shown in FIG. 5 on a portable skid-type platform means 230 for enabling transport to and support of the system at a wellhead site. The platform means has flat upper and lower surfaces 232, 234 and upwardly and outwardly inclined opposite end surfaces 236, 238. Rigid I-beams and plate mounting means 240, 241, 242, 243, 244, etc. are fixedly attached to the platform means for supporting the system components. The low pressure primary separator means 100 and the high pressure secondary separator means are mounted at one end of the platform means. The compressor means 102 and the motor means 103 are centrally mounted on the platform means 102. The forced draft gas cooler and engine radiator means 126 are mounted on the other end of the platform means. The system shown in FIGS. 6 and 7 does not employ a safety scrubber means 110, but a mounting means for a safety scrubber means is illustrated at 246. The platform means 230 is approximately 21 feet by 7-½ feet. The construction and arrangement of the apparatus enables assembly and mounting of the system components at a manufacturing plant to provide a portable production unit which may be transported to the wellhead site on a flat-bed trailer or truck and moved from one wellhead site to another wellhead site while also facilitating hook-up, installation, operation and maintenance at the wellhead site.

In normal continuous operation of the illustrative system of FIGS. 5A & 5B, the compressor means 102 induces and maintains continuous flow of well effluent from the well inlet into the low pressure separator means 100 and from the low pressure separator means to the compressor means 102 through the gas scrubber means 110. It is to be understood that the use of a gas scrubber means 110 is optional and may not be required in some situations. The compressor means also raises the pressure of the gases discharged from discharge ports 113, 114 to a relatively high flow pressure sufficient to enable unrestricted flow of the gases into the sales gas pipeline from the high pressure separator means 104. The compressor means also substantially raises the temperature of the discharged gases and the heat of compression is used to supply heat to the low pressure separator means 100 by causing the compressed gases to flow through heat exchanger means 116. It is to be understood that the compressor means 102 may be of any suitable design including one, two or more compression cylinders and also providing multiple stages of compression. In order to meet sales gas line temperature requirements, the compressed gases are cooled by the forced draft cooler means 126 prior to delivery to the high pressure separator means 104 and the cooling also increases the efficiency of the high pressure separator means in removing additional liquids prior to delivery of the gases into the sales gas pipeline. Thus, the low pressure separator 100 operates at a relatively low pressure (e.g., 100 to 500 psig) and a relatively high temperature (e.g., liquid bath temperatures of 70 to 150 degrees F.) while the high pressure separator 104 operates at a relatively high pressure (e.g., 300 to 1000 psig) and a relatively low temperature (e.g., liquid bath temperatures of 60 to 120 degrees F.). Supply gas obtained from the high pressure separator in line 150 also will have a relatively high pressure and is delivered to the supply gas pressure reduction regulator means 156 for pressure reduction before entering drip pot means 160. Supply gas heat exchanger means 152 is associated with the compressed gas heat exchanger means in the heated liquid bath in the low pressure separator means 100 to increase the supply gas temperature to a temperature sufficient to prevent freezing during pressure reduction (e.g., 1000 psig to 75 psig) through supply gas pressure regulator means 156. The primary purpose of circulation of engine coolant through the fuel gas volume pot heat exchanger means 185 and separator heat exchanger means 187 is to assist in cold weather start-up of the system. In normal continuous operation of the system, heat exchanger means 187 may be bypassed or shut off so that engine coolant flow is terminated or limited to gas scrubber heat exchanger means 189 when a gas scrubber means 110 is employed.

It is to be understood that the operating parameters of the system are variably dependent on particular wellhead, sales gas pipe line and ambient conditions and parameters. By way of illustration, system operating conditions (at an ambient temperature of 100 degrees F.) for a wellhead having a volume of 1.5 million cubic feet per day at a specific gravity 0.65 and a gas pipe line having a line pressure of 650 psig and a line temperature of 120 degrees F. may be approximately as follows: compressor suction inlet port and primary separator gas pressure of 240 psig and temperature of 70 degrees F.; compressor discharge port gas pressure of 655 psig and temperature of 193 degrees F.; primary separator liquid bath temperatures of 140 degrees F.; secondary separator gas pressure of 650 psig and temperature of 120 degrees F.; and secondary separator liquid bath temperature of 120 degrees F.

The illustrative system provides a method of separating liquids from gas in wellhead effluent from a low volume natural gas well to produce sales gas while establishing and maintaining continuous unrestricted flow of wellhead effluent from the well to a primary separator and of sales gas from a secondary separator to a sales gas pipeline. The wellhead effluent is delivered to a relatively low pressure primary separator means in which heavy end hydrocarbons in liquid phase and water in liquid phase are separated from gaseous hydrocarbon components while being subject to induced flow of gaseous hydrocarbon components to the low pressure inlet port of a gas compressor means. The gaseous hydrocarbon components are subject to compression causing an increase of pressure to a pressure approximately equal to the sales gas line pressure and an increase of temperature sufficient to provide heat for operation of the low pressure separator means. The compressed gaseous hydrocarbon components are delivered from the discharge port of the compressor means to a heat exchanger means in the low pressure separator means so that the liquids in the separator means are heated by the heat of compression in the compressed gases. Then, the compressed gases are cooled and then the compressed gases are delivered to a relatively high pressure separator means whereat additional liquids are removed from the compressed gas at pressures substantially higher than operating pressure of the low pressure separator and approximately equal to or greater than standard sales gas pipe line pressure and at temperatures approximately equal to or less than standard sales gas pipe line temperature. More specifically, the method comprises causing flow of the effluent into a low pressure separator means by compression of the gases downstream of the low pressure separator means; supplying heat to the low pressure separator means to provide a relatively high operational temperature in the separator means; separating effluent in the low pressure separator means into a body of liquid hydrocarbons and a body of water and a body of gaseous hydrocarbons; causing flow of the body of gaseous hydrocarbons from the low pressure separator means by compression of the gaseous hydrocarbons in compressor means located downstream of the low pressure separator means; increasing the pressure and temperature of the gaseous hydrocarbons by compression in the compressor means to a pressure substantially equal to or greater than the standard pressure in the sales gas pipe line and to a temperature greater than the standard temperature in the sales gas pipe line and sufficient for supplying heat for processing the effluent in the low pressure separator means; delivering the compressed gaseous hydrocarbons from the compressor means to heat exchanger means located in the low pressure separator means and transferring sufficient heat from the compressed gaseous hydrocarbons to the low pressure separating means to process the effluent in the low pressure separator means; delivering the compressed gases from the heat exchanger means in the low pressure separator means to cooling means located downstream thereof and cooling the compressed gases to a temperature approximately equal to the standard temperature of the sales gas pipe line while maintaining a pressure of the compressed gases substantially equal to or greater than the standard pressure of the sales gas pipe line; delivering the cooled compressed gaseous hydrocarbons to a relatively high pressure separator means located downstream of the cooling means and removing additional heavy end hydrocarbons from the cooled compressed gases at a processing temperature substantially less than the processing temperature in the low pressure separator means and providing a body of residual liquid hydrocarbons and a residual body of compressed gas having a pressure approximately equal to or greater than the standard sales gas line pressure; and continuously forcing flow of the residual body of compressed gas from the high pressure separator means into the sales gas line at pressures approximately equal to or in excess of the standard sales gas pipe line pressure by continuous compression of gases in the compression means and continuous delivery of the high pressure compressed gases from the compression means to the relatively high pressure separation means. The aforedescribed apparatus, methods and systems may be variously employed to achieve the advantages, objectives and results provided by the present invention.

It is to be understood that the system of FIGS. 5–7 is constructed and arranged to operate at variable elevated processing temperatures substantially in excess of the freezing point of water (i.e., 32 degrees F.) and above the hydrate formation temperature of natural gas and variable elevated processing pressures substantially in excess of 20 psig. While normal operating process pressures and temperatures may vary and be controllably varied from well site to well site due to variations in pressures and temperatures of wellhead effluent, gas pipe line pressures, etc. at various well sites, the low pressure primary separator means will be typically operated at pressures in the range of 100 psig to 600 psig and temperatures in the range of 70 degrees F. to 150 degrees F.; the secondary high pressure separator means will be typically operated at pressures in the range of 400 psig to 1000 psig and temperatures in the range of 65 degrees F. to 120 degrees F.; and the compressor means will be typically operated at discharge pressures of 300 psig to 1000 psig and discharge temperatures in the range of 150 degrees F. to 250 degrees F. Thus, the terms "relatively low", "relatively high" and "elevated" and "substantially elevated" as may be used in the specification and claims hereof are intended to be given an interpretation consistent with the foregoing general description.

The terms "flash" or "flashing" as used herein will be understood to mean the release and formation of hydrocarbon gases and vapors from liquid hydrocarbons by reduction in pressure or increase in temperature of liquid hydrocarbons. The term "scrubbing" as used herein will be understood to mean the separation and removal of heavy end hydrocarbons from light end hydrocarbons in gaseous or vaporous phase and/or the separation and removal of gaseous or vaporous light end hydrocarbons from heavy end hydrocarbons in liquid phase. For example, in the low pressure separator means of the present invention, the pressure of the incoming liquid hydrocarbons from the high pressure separator means is reduced at the inlet to cause removal and separation of some of the light end hydrocarbons by "flashing". In addition, the body of essentially heavy end liquid hydrocarbons collected in the tanks at the bottom of the high pressure separator means and the low pressure separator means is heated to cause residual light end hydrocarbons to be released and separated therefrom by "flashing". Increase in temperature of the liquid essentially heavy end hydrocarbons causes release of light end hydrocarbons while decrease in temperature of the essentially light end gaseous and vaporous hydrocarbons causes release of heavy end hydrocarbons. Also, when the essentially heavy end liquid hydrocarbons are delivered to the storage tank means, reduction in pressure causes flashing of residual light end components in the storage tank means unless stabilized to vapor pressure less than atmospheric. It will be further understood, that the separating processes inevitably result in a variable mixture of both light end and heavy end hydrocarbons in either the gaseous, vaporous or liquid phases because the processes cause greater or lesser amounts of each to be carried away with the other.

It is intended that the appended claims be construed to include alternative embodiments of the invention except insofar as limited by the prior art.

What is claimed is:

1. A system for processing relatively low volume natural gas wellhead effluent to separate heavy end hydrocarbon and water constituents from light end hydrocarbon constituents and produce sales gas consisting primarily of light end hydrocarbon constituents for delivery to a sales gas pipe line and a liquid body of hydrocarbons consisting primarily of heavy end hydrocarbon constituents for delivery to storage tank means, the system comprising:

a three phase relatively low pressure primary separator means for receiving the wellhead effluent and for separating light end hydrocarbons from heavy end hydrocarbons and water and for producing at temperatures in excess of gas hydrate temperatures a relatively low pressure body of gaseous hydrocarbons consisting primarily of light end hydrocarbons and a first body of liquid hydrocarbons consisting primarily of heavy end hydrocarbon components and a second liquid body consisting primarily of water components;

compressor means connected to said primary separator means for receiving a stream of relatively low pressure gaseous hydrocarbons from said primary separator means and for compressing said stream of relatively low pressure gaseous hydrocarbons while increasing the temperature thereof to provide a stream of compressed heated gaseous hydrocarbons having a temperature and pressure substantially in excess of the temperature and pressure of the wellhead effluent entering said primary separator means and the temperature and pressure of sales gas in the sales gas pipe line;

heat exchanger means mounted in said primary separator means for receiving said stream of compressed heated gaseous hydrocarbons and transferring heat of compression from said compressed heated gaseous hydrocarbons to said body of liquid hydrocarbons in said primary separator means;

cooler means connected to said heat exchanger means for receiving said stream of compressed heated gaseous hydrocarbons from said heat exchanger means and for reducing the temperature of said stream of compressed heated gaseous hydrocarbons and for providing a stream of reduced temperature relatively high pressure compressed gaseous hydrocarbons having a pressure substantially in excess of the pressure of said body of gaseous hydrocarbons in said primary separator means and approximately equal to or in excess of the pressure of the sales gas in the sales gas pipe line;

two phase relatively high pressure secondary separator means connected to said cooler means for receiving said stream of reduced temperature relatively high pressure compressed gaseous hydrocarbons from said cooler means and for separating light end hydrocarbons from heavy end hydrocarbons and for providing a body of sales gas hydrocarbons having a pressure substantially equal to or in excess of the pressure of the sale gas in the sales gas pipe line and consisting substantially of only light end hydrocarbons and a second body of liquid hydrocarbons consisting substantially only of heavy end hydrocarbon components;

gas pipe line outlet means connected to said secondary separator means for connecting and delivering said body of sales gas hydrocarbons to a sales gas pipe line;

liquid hydrocarbon collection tank means associated with said secondary separator means for collecting said second body of liquid hydrocarbons and being connected to said primary separator means for delivery of said second body of liquid hydrocarbons to said primary separator means for recycling therein including reduction of pressure causing flashing of light end hydrocarbons contained in said second body of liquid hydrocarbons and addition of flashed light end hydrocarbons to said first body of gaseous hydrocarbons in said primary separation means; and condensate storage tank means connected to said primary separator means for receiving liquid hydrocarbons from said primary separator means.

2. The system as defined in claim 1 and further comprising:

scrubber means mounted between said primary separator means and said compression means for removing additional heavy end hydrocarbons from said stream of light end hydrocarbons prior to compression.

3. The system as defined in claim 1 and further comprising:

gas powered engine means for driving said compressor means; and said cooling means being a force air cooling means driven by said engine means.

4. The system as defined in claim 3 and wherein:

said engine means including a coolant system and said coolant system including a portion connected to said primary separator means for circulating coolant through said primary separator means.

5. The system as defined in claim 3 and wherein:

said engine means being operable by supply gas obtained from the body of sales gas in said second separator means and being connected through a supply gas system to said secondary separator means for receiving natural supply gas from said sales gas stream.

6. The system as defined in claim 5 and further comprising:

gas operated control means for controlling temperatures and pressures in the system and being operable by supply gas supplied from said body of sales gas in said secondary separator means.

7. The system as defined in claim 6 and further comprising:

pressure reduction means for receiving said supply gas from said secondary separator means and reducing the pressure of the supply gas; and drip pot means for receiving the reduced supply gas and for delivering supply gas to said engine means and said control means.

8. The system as defined in claim 7 and further comprising:

supply gas heat exchange means in said primary separator means for receiving supply gas from said secondary separator means and for heating said supply gas in said primary separator means prior to delivery to said pressure reduction means.

9. The system a defined in claim 8 and further comprising:

gas dryer means associated with said secondary separator means for removing additional liquids from said supply gas prior to delivery to said supply gas heat exchanger means.

10. The system as defined in claim 1 and wherein said hydrocarbon liquid collection means associated with said secondary separator means comprises:

a collection tank extending between said secondary separator means and said primary separator means for collecting said second body of liquid hydrocarbons and having a bottom portion located in said primary separator means in heat exchange relationship with said first body of liquid hydrocarbons in said primary separator means for transfer of heat therebetween.

11. A method of producing sales gas from effluent from a low volume natural gas well head comprising:

delivering the effluent to a primary low pressure separator means at substantially wellhead temperature and pressure;

separating the effluent in the primary low pressure separator means at temperatures in excess of gas hydrate temperatures into a first body of gaseous light end hydrocarbon constituents and into liquid water constituents and into a first body of liquid hydrocarbon constituents including a portion of the light end hydrocarbon components and heavy end hydrocarbon constituents in liquid and vapor phases;

delivering the first body of gaseous light end hydrocarbon constituents to a compressor means and compressing the gaseous light end hydrocarbon constituents to increase the pressure and temperature thereof to a pressure and temperature substantially in excess of the pressure and temperature of the effluent entering the primary low pressure separator means while creating a differential pressure between the compressor means and the well head effluent sufficient to establish and maintain flow of effluent into the primary low pressure separator means;

delivering the compressed gaseous light end hydrocarbon constituents to a heat exchange means in the primary low pressure separator means to maintain the temperature of the effluent and the first body of gaseous light end hydrocarbon constituents and the first body of liquid hydrocarbon constituents contained in the primary low pressure separator means at a suitable relatively high processing temperature in excess of gaseous hydrate temperatures;

thereafter delivering the compressed gaseous light end hydrocarbons from the heat exchange means in the primary low pressure separator means to a cooling means to reduce the temperature thereof;

thereafter delivering the compressed first body of gaseous light end hydrocarbons to a secondary high pressure separator means for separation into a second body of gaseous light end hydrocarbons having a relatively high pressure in excess of the pressure of the first body of gaseous light end hydrocarbons and sufficient to enable flow into a sales gas pipe line and a second body of liquid heavy end hydrocarbons;

discharging the second body of gaseous light end hydrocarbons to a sales gas pipe line; and returning the second body of liquid heavy end hydrocarbons from the secondary high pressure separation means to the primary low pressure separation means for recycling with the first body of liquid heavy end hydrocarbon means.

12. The invention as defined in claim 11 and wherein:

the compression means creates a pressure differential such as to maintain continuous flow of effluent into the primary low pressure separator means from the well head and continuous flow of the first body of gaseous hydrocarbons from the primary low pressure separation means to the secondary high pressure separation means and continuous flow of the second body of gaseous light end hydrocarbons from the secondary high pressure separation means into the sales gas pipe line.

13. The invention as defined in claims 1 or 11 and wherein:

the primary source of heat for the system is the heat of compression generated by said compression means and the flow rate between the primary separation means and the sales gas line is primarily determined by the pressure differential between the compression means and the primary separator means.

14. A system for production of sales gas from wellhead effluent at the wellhead for delivery to a sales gas pipe line comprising:

a three phase low pressure primary separator means for receiving the wellhead effluent and separating gaseous components from liquid hydrocarbon and non-hydrocarbon liquid components and for producing a first stage stream of gaseous hydrocarbon components and a first body of liquid hydrocarbons;

compressor means for maintaining flow of and for receiving the first stage stream of gaseous components from the primary separator means and for providing a low pressure induction port and a high pressure discharge port and for providing a second stage relatively high pressure compressed gaseous discharge stream having a pressure higher than the pressure of the wellhead effluent and higher than the first stage stream of gaseous hydrocarbon components;

a two phase high pressure secondary separator means for receiving the relatively high pressure compressed gaseous stream from the compressor means and for separating gaseous hydrocarbon components from liquid hydrocarbon components in the compressed gaseous stream and producing a sales gas stream for delivery to the sales gas pipe line and a second residual body of liquid hydrocarbons;

heat exchanger means associated with said primary separator means for receiving the compressed gaseous stream from the compressor means prior to delivery to the secondary separator means for supply heat to the primary separator means and for maintaining a suitable processing temperature in the primary separator means; and the construction and arrangement of the system being such that residual liquid hydrocarbons in the secondary separator means are returned to the first separator means for further processing therein and heat for maintaining processing temperatures in the system is provided by heat of compression and said compressor means maintains suitable pressure differentials between the wellhead effluent and the sales gas in the sales gas pipe line to enable continuous flow in the system.

15. A method of separating liquids from gas in wellhead effluent from a low volume natural gas well to produce sales gas while maintaining continuous flow of wellhead effluent from the well and of sales gas to a sales gas pipeline comprising:

delivering the wellhead effluent to a relatively low pressure primary separator means and separating heavy end hydrocarbons in liquid phase and water in liquid phase from gaseous hydrocarbon components in the effluent at temperatures in excess of gas hydrate temperatures while maintaining a sufficient pressure differential between the wellhead effluent and the internal pressure of the primary separator means to maintain flow of effluent into the primary separator means by inducing flow of gaseous hydrocarbon components to a low pressure inlet port of a gas compressor means;

compressing the gaseous hydrocarbon components in the compressor means to cause an increase of pressure of the gaseous hydrocarbon components to a pressure in excess of the pressure of the sales gas in the sales gas pipe line and to cause an increase of temperature of the gaseous hydrocarbon components sufficient to provide heat required for operation of the low pressure separator means;

delivering the compressed gaseous hydrocarbon components from a discharge port of the compressor means to a heat exchanger means in the low pressure separator means and heating the effluent, the liquids and the gases in the low pressure separator means by the heat of compression in the compressed gases;

cooling the compressed gases downstream of the low pressure separator means and delivering the cooled compressed gases to a relatively high pressure separator means; and separating additional liquids from the cooled compressed gas in the high pressure separator means at pressures substantially higher than operating pressure of the low pressure separator and approximately equal to or greater than the pressure of the sales gas in the sales gas pipe line and at temperatures in excess of gas hydrate temperatures and approximately equal to or less than standard sales gas pipe line temperature.

16. A method of separating liquids from gas in wellhead effluent from a low volume natural gas well to produce sales gas while maintaining flow of wellhead effluent from the well and flow of sales gas to a sales gas pipeline comprising:

causing and maintaining continuous flow of the effluent into a low pressure separator means by compression of gases downstream of the low pressure separator means;

continuously heating the effluent in the low pressure separator means to provide a relatively high operational temperature in the separator means in excess of gas hydrate temperatures;

continuously separating effluent in the low pressure separator means into a body of liquid hydrocarbons and a body of water and a body of relatively low pressure gaseous hydrocarbons;

continuously causing a flow of the body of gaseous hydrocarbons from the low pressure separator means by by compression of the gaseous hydrocarbons in compressor means located downstream of the low pressure separator means;

continuously increasing the pressure and temperature of the gaseous hydrocarbons by compression in the compressor means to a relatively high pressure substantially equal to or greater than the standard pressure in the sales gas pipe line and to a temperature greater than the standard temperature in the sales gas pipe line and sufficient for supplying heat for processing the effluent in the low pressure separator means;

continuously delivering the compressed gaseous hydrocarbons from the compressor means to heat exchanger means located in the low pressure separator means and transferring sufficient heat from the compressed gaseous hydrocarbons to the low pressure separating means to process the effluent in the low pressure separator means;

continuously delivering the compressed gases from the heat exchanger means in the low pressure separator means to cooling means located downstream thereof and cooling the compressed gases to a temperature approximately equal to the standard temperature of the sales gas pipe line while maintaining a pressure of the compressed gases substantially equal to or greater than the standard pressure of the sales gas pipe line;

continuously delivering the cooled compressed gaseous hydrocarbons to a relatively high pressure separator means located downstream of the cooling means and removing additional heavy end hydrocarbons from the cooled compressed gases at a processing temperature in excess of gas hydrate temperatures and providing a body of residual liquid hydrocarbons and a body of sales gas having a pressure approximately equal to or greater than the standard sales gas line pressure; and continuously forcing flow of the body of sales gas from the high pressure separator means into the sales gas line at pressures approximately equal to or in excess of the standard sales gas pipe line pressure by continuous compression of gases in the compression means and continuous delivery of the high pressure compressed gases from the compression means to the relatively high pressure separation means.

17. The invention as defined in claim 16 and further comprising:

collecting the residually hydrocarbon liquids in the high pressure separator means in a collection tank having a lowermost tank portion extending into the low pressure separator and located in heat transfer relationship with liquids in the low pressure separator;

heating the residual hydrocarbon liquids in the collection tank by heat transfer from the liquids in the low pressure separator to cause flashing of residual light end hydrocarbons in the residual hydrocarbon liquids and flow of residual light end hydrocarbons to the body of sales gas in the high pressure separator means; and delivering residual hydrocarbon liquids from the collection tank means in the high pressure separator to the low pressure separator for recycling therein.

18. The invention as defined in claim 17 and further comprising:

scrubbing the gaseous hydrocarbons prior to delivery to the compressor to remove additional liquids before compression of the gaseous hydrocarbons.

19. The invention as defined in claim 17, and further comprising:

obtaining supply gas for the system from the body of sales gas in the high pressure separator;

passing the supply gas through a heat exchanger in the low pressure separator means and increasing the temperature of the supply gas in the heat exchanger in the low pressure separator;

reducing the pressure of the supply gas after temperature increase in the heat exchange in the low pressure separator to provide a body of relatively low pressure supply gas; and using the supply gas to operate control devices associated with the low pressure separator and the high pressure separator.

20. The invention as defined in claim 19 and further comprising:

operating the compressor by a natural gas powered engine; and using the supply gas as fuel gas for the engine.

21. The invention as defined in claim 20 and further comprising:

providing heat for start-up of the system by circulating engine coolant through heat exchanger devices associated with the low pressure separator and with the fuel gas supply apparatus and with the scrubber.

22. The invention as defined in claim 20 and further comprising:

using an engine driven fan device and a radiator apparatus associated with the engine for cooling the compressed hydrocarbon gases by passing the compressed hydrocarbon gases through the radiator apparatus while blowing air from the fan device through the radiator apparatus.

23. The invention as defined in claims 3 or 22 and further comprising:

a portable platform means for supporting the system during transport to the wellhead and during use at the wellhead.

24. The invention as defined in claim 23 and wherein:

said low pressure separator means being mounted on one end portion of said platform means;

said high pressure separator means being mounted on and above said low pressure separator means;

said compressor means and said engine means being mounted on a central portion of said platform means; and said cooler means being mounted on the other end portion of said platform means.

* * * * *